US010378555B2

(12) United States Patent
Back et al.

(10) Patent No.: US 10,378,555 B2
(45) Date of Patent: Aug. 13, 2019

(54) ELECTRIC COMPRESSOR FOR USE IN A MOTOR VEHICLE HAVING A HOUSING WITH AN INNER CIRCUMFERENTIAL RECESS CLOSED BY A CONTROL UNIT TO FORM A COOLING DUCT

(71) Applicant: Magna Powertrain GmbH & Co KG, Lannach (AT)

(72) Inventors: Wolfgang Back, Oftering (AT); Nicolai Schmolzer, Arriach (AT); Gerd Schlager, Kefermarkt (AT)

(73) Assignee: MAGNA POWERTRAIN BAD HOMBURG GMBH, Bad Homberg (DE)

( * ) Notice: Subject to any disclaimer, the term of this patent is extended or adjusted under 35 U.S.C. 154(b) by 261 days.

(21) Appl. No.: 15/214,913

(22) Filed: Jul. 20, 2016

(65) Prior Publication Data

US 2017/0037872 A1 Feb. 9, 2017

(30) Foreign Application Priority Data

Aug. 3, 2015 (DE) ..... 10 2015 214 785

(51) Int. Cl.
*F04D 29/58* (2006.01)
*F04D 25/06* (2006.01)
(Continued)

(52) U.S. Cl.
CPC ..... *F04D 29/5813* (2013.01); *F02B 33/40* (2013.01); *F02B 39/10* (2013.01);
(Continued)

(58) Field of Classification Search
CPC ..... F04D 29/5813; F04D 17/10; F04D 25/06; F04D 25/068; F04D 29/4206;
(Continued)

(56) References Cited

U.S. PATENT DOCUMENTS 5,857,348 A * 1/1999 Conry ..... F04D 25/06 417/423.12
8,974,197 B2 * 3/2015 VanBritson ..... F01C 21/02 417/410.3
(Continued)

FOREIGN PATENT DOCUMENTS

CN 101052807 A 10/2007
CN 101666303 A 3/2010
(Continued)

OTHER PUBLICATIONS

Search Report dated Apr. 25, 2018 issued in corresponding Chinese Patent Application No. 2016106290952.

*Primary Examiner* — Kenneth J Hansen
*Assistant Examiner* — Benjamin Doyle
(74) *Attorney, Agent, or Firm* — Dickinson Wright PLLC

(57) ABSTRACT

An electric compressor for compressing a gas, and in particular, an electric compressor for a motor vehicle comprising a compressor wheel, an electric motor, wherein the compressor wheel can be driven by the electric motor, a control unit, wherein the electric motor can be controlled by the control unit, and a housing having at least one open end for receiving the control unit. The housing has at least one recess on the inner circumference at the open end that is designed so as to be open in the direction of the housing interior. The control unit can be inserted into the housing in such a way that it closes the open end of the housing and the recess on the inner circumference.

16 Claims, 5 Drawing Sheets

(51) Int. Cl.

| | |
|---|---|
| ***F04D 29/62*** | (2006.01) |
| ***F02B 33/40*** | (2006.01) |
| ***F02B 39/10*** | (2006.01) |
| ***F04D 17/10*** | (2006.01) |
| ***F04D 29/42*** | (2006.01) |

(52) U.S. Cl.
CPC ..... *F04D 17/10* (2013.01); *F04D 25/06* (2013.01); *F04D 25/068* (2013.01); *F04D 29/4206* (2013.01); *F04D 29/624* (2013.01); *F05B 2240/14* (2013.01); *F05B 2240/30* (2013.01); *F05B 2240/57* (2013.01); *F05B 2260/20* (2013.01); *F05B 2280/4007* (2013.01)

(58) Field of Classification Search
CPC ..... F04D 29/624; H02K 9/19; F05B 2240/14; F05B 2240/30; F05B 2240/57; F05B 2260/20; F05B 2280/4007; F02B 33/40; F02B 39/10
USPC ..... 310/54, 58; 417/423.8, 423.14; 60/605.3
See application file for complete search history.

(56) References Cited

U.S. PATENT DOCUMENTS

| | | | | |
|---|---|---|---|---|
| 9,017,045 | B2 * | 4/2015 | Kinoshita | F01C 21/10 417/410.1 |
| 2003/0086800 | A1 | 5/2003 | Kurihara et al. | |
| 2004/0109772 | A1 * | 6/2004 | Ogawa | F01C 21/10 417/410.5 |
| 2004/0219401 | A1 * | 11/2004 | Hobmeyr | H01M 8/04097 429/415 |
| 2008/0283216 | A1 * | 11/2008 | Horng | F04D 25/068 165/47 |
| 2010/0074772 | A1 * | 3/2010 | Hoshino | F04B 35/04 417/410.1 |
| 2011/0020153 | A1 | 1/2011 | Murakami | |
| 2011/0103979 | A1 * | 5/2011 | Taguchi | F04C 23/008 417/410.1 |
| 2011/0135519 | A1 * | 6/2011 | Cho | F04D 17/10 417/423.7 |
| 2014/0010684 | A1 * | 1/2014 | Joschko | H05K 7/209 417/410.1 |
| 2014/0144412 | A1 * | 5/2014 | An | F02B 39/10 123/562 |
| 2015/0292511 | A1 * | 10/2015 | Sakai | H02K 7/14 417/423.1 |
| 2015/0319839 | A1 * | 11/2015 | Ichikawa | F04C 18/0215 310/64 |
| 2017/0302139 | A1 * | 10/2017 | Sakai | H02K 11/33 |

FOREIGN PATENT DOCUMENTS

| | | | |
|---|---|---|---|
| CN | 102094840 | A | 6/2011 |
| CN | 203321833 | U | 12/2013 |
| CN | 103591050 | A | 2/2014 |
| DE | 19736907 | A1 | 3/1999 |
| DE | 10056430 | A1 | 5/2002 |
| DE | 10251219 | A1 | 5/2003 |
| DE | 10245798 | B4 | 8/2004 |
| DE | 102007005233 | A1 | 8/2008 |
| DE | 102008000124 | A1 | 7/2009 |
| WO | WO9910654 | A1 | 3/1999 |

* cited by examiner

ELECTRIC COMPRESSOR FOR USE IN A MOTOR VEHICLE HAVING A HOUSING WITH AN INNER CIRCUMFERENTIAL RECESS CLOSED BY A CONTROL UNIT TO FORM A COOLING DUCT

CROSS-REFERENCE TO RELATED APPLICATIONS

This application claims the benefit and priority of German Application No. DE 102015214785.1, filed Aug. 3, 2015. The entire disclosure of the above application is incorporated herein by reference.

TECHNICAL FIELD

The present invention relates to an electric compressor for compressing gas, and in particular, to an electric compressor for use in a motor vehicle.

BACKGROUND

This section provides background information related to the present disclosure which is not necessarily prior art.

In general, compressors in the automotive sector are associated especially with the desire for an increase in the power and efficiency of an internal combustion engine of a motor vehicle.

One of the probably best known embodiments of a compressor is the exhaust turbocharger. The exhaust turbocharger is used to ensure an adequate quantity of combustion air in the cylinders of the internal combustion engine by compressing ambient air or an ambient air/exhaust gas mixture and thus supplying the cylinders with this combustion air at excess pressure.

In general, exhaust turbochargers consist of an exhaust turbine and a compressor wheel, wherein the exhaust turbine and the compressor wheel are arranged on a common shaft. The exhaust turbine converts the heat and kinetic energy of the exhaust gas from the internal combustion engine into rotational energy. This rotational energy is transferred via the common shaft to the compressor wheel. By means of the compressor wheel, ambient air or a mixture of ambient air and exhaust gas is drawn in and compressed. It is thereby possible to achieve a higher working pressure for the same temperature in the cylinder of the internal combustion engine.

As long as there is sufficient exhaust gas flowing in on the side of the internal combustion engine and driving the exhaust turbine, the speed of rotation is sufficient to bring about an excess pressure on the intake side. However, when accelerating the motor vehicle, for example, the turbo may respond with a delay (even) at relatively high speeds of rotation—this state being commonly known as "turbo lag".

There are many approaches to counteracting the occurrence of turbo lag. For example, the inertia of the exhaust turbine can be reduced by making it smaller. Although this lowers the efficiency of the turbo, the exhaust turbine can be driven even by a weak exhaust gas flow.

Another approach in this context is the use of an (additional) electrically driven compressor (electric compressor), for example, said compressor operating independently of the exhaust gas flow of the internal combustion engine.

The publication WO 99/10654 describes an electrically driven compressor, for example, wherein the compressor and the electric drive motor are arranged coaxially with one another on a shaft and are accommodated in a common housing. In particular, the primary object here is to specify a compressor which is of as small construction as possible.

To be able to ensure safe and trouble-free operation of the electric motor, fault-free operation of the control unit is necessary in particular, and this, in turn, entails adequate cooling of the control unit or electronic modules of the control unit. The primary consideration here is the desire to cool the electronic modules of the control unit of the electric compressor without significant additional expenditure on construction and in a way which saves as much space as possible.

Different approaches to cooling electronic components are known from the prior art.

Thus, document DE 10 2007 005 233 A1, for example, describes a power module having at least one semiconductor chip arranged on a substrate and having electrical connections leading to the outside. The semiconductor chip arranged on the substrate and some of the connections are coupled to give close thermal contact with an electrically insulating material of good thermal conductivity that is sealed off with respect to the outside. The material is arranged around the substrate and the semiconductor chip in such a way that a flat structural element is formed that can be coupled to a cooling medium, with the exception of the side with the contacts leading to the outside. It is necessary here to wrap the entire power module with thermally conductive material and to seal it hermetically to enable the power module to be inserted into a cooling duct.

SUMMARY

This section provides a general summary of the disclosure, and is not a comprehensive disclosure of its full scope or all of its features.

It is an object of the invention to specify an electric compressor of the stated type which ensures safe and reliable operation without significant additional expenditure on construction.

The object is achieved by an electric compressor for compressing a gas, in particular for a motor vehicle, comprising a compressor wheel, an electric motor, wherein the compressor wheel can be driven by means of the electric motor, a control unit, wherein the electric motor can be controlled by means of the control unit, and a housing, wherein the housing has at least one open end for receiving the control unit, and wherein the housing has at least one recess on the inner circumference at the open end, wherein the recess is designed so as to be open in the direction of the housing interior, and the control unit can be inserted into the housing in such a way that it closes the open end of the housing and the recess on the inner circumference.

The electric compressor according to the invention has a compressor wheel, an electric motor, a control unit and a housing.

According to the present invention, the electric motor serves to drive the compressor wheel.

The electric motor has a rotor and a stator having at least one stator winding.

The rotor of the electric motor is preferably arranged for conjoint rotation on the shaft and/or is formed integrally with the shaft.

The compressor wheel is preferably arranged for conjoint rotation on the shaft and/or is formed integrally with the shaft.

The rotational energy generated by the electric motor is transferred to the compressor wheel via the common shaft.

The control unit forms the power and signal electronics for the electric motor and preferably comprises a circuit board on which various electronic modules, e.g. capacitors, semiconductor chips etc., can be arranged.

However, the control unit can also be taken to mean a plug connector, in which case the circuit board, including the various electronic modules arranged thereon, is embodied as an external control module.

According to the invention, the electric motor can be controlled by means of the control unit, wherein the electrical connection between the electric motor and the control unit is made via at least one connecting element.

The housing has at least one open end for receiving the control unit.

According to the present invention, the housing has at least one recess on the inner circumference at the open end, wherein the recess is designed so as to be open in the direction of the housing interior of the housing.

According to the invention, the control unit can be inserted into the housing in such a way that it closes the open end of the housing, on the one hand, and the recess on the inner circumference, on the other hand.

By closing the recess by means of the control unit, in particular, it is possible to form a closed duct, in particular a cooling duct, in a simple manner.

Developments of the invention are indicated in the dependent claims, the description and the attached drawings.

As a particularly preferred option, there can be a flow of a cooling fluid, e.g. a cooling liquid or a cooling gas, through the recess on the inner circumference of the housing.

By virtue of the flow of cooling fluid through the recess closed by means of the control unit, adequate cooling of the control unit is achieved in a simple manner. The control unit is integrated at least partially directly into the cooling circuit.

The control unit is preferably at least partially surrounded by a jacket, in particular at the point and/or the points at which the control unit closes the recess.

The jacket is preferably composed of a material of good thermal conductivity.

Moreover, the material of the jacket is preferably an electrical insulator and is fluid tight.

The material of the jacket is preferably a polymeric material, in particular a thermoset.

It is advantageous if the housing is of substantially cylindrical design on its housing inner side, in the region of the open end.

In front of and behind the recess, in relation to a direction along a longitudinal axis of the housing, the housing preferably has in each case at least one annular groove. The annular grooves preferably each serve to receive a seal element.

Through the arrangement of a seal element in front of and behind the recess, a particularly fluid-tight cooling structure is provided for the control unit.

The housing of the electric compressor according to the invention is preferably of single-part or multi-part construction.

In an advantageous embodiment of the electric compressor according to the invention, the electric motor of the electric compressor is arranged at least partially in the housing.

Through the design according to the invention of the recess and thus of a cooling duct, reliable operation of the electric compressor and, in particular, of the control unit of the electric compressor is ensured, while the assembly is as compact as possible and as far as possible optimized in terms of components.

Apart from its actual function of controlling the electric motor, the control unit furthermore performs the function of a housing cover and of a closure element for the recess on the inner circumference at the open end of the housing.

By means of the recess on the inner circumference closed by the control unit, it is possible to achieve integrated cooling for the control unit of the electric compressor according to the invention in a simple manner and furthermore in a low-cost way.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DESCRIPTION

One or more example embodiments of an electric compressor are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
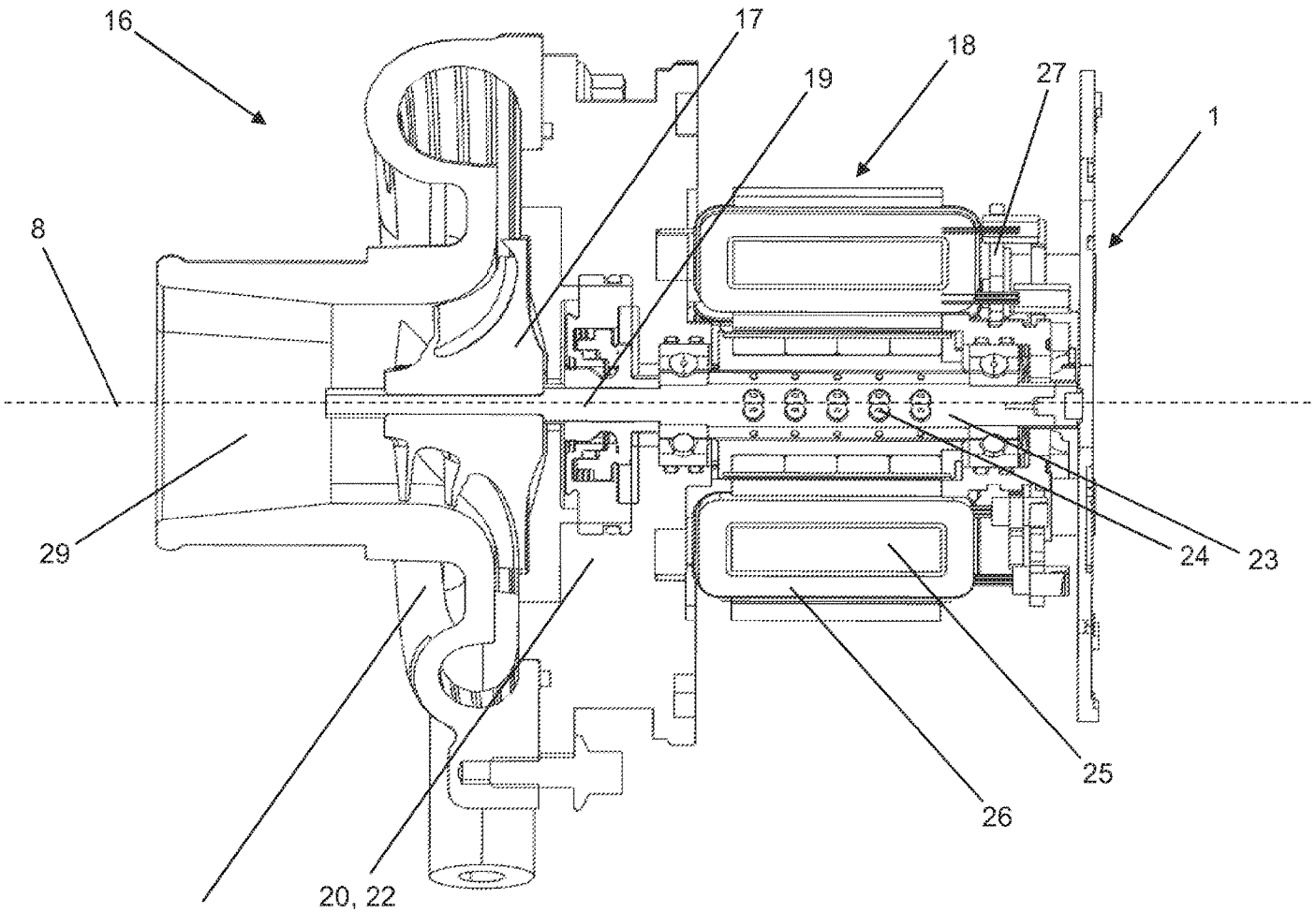
FIG. 1 shows a longitudinal section through an electric compressor according to the invention.

FIG. 1 shows a longitudinal section through an illustrative electric compressor 16 according to the invention. The electric compressor 16 has a compressor wheel 17, an electric motor 18, a control unit 1 and a housing 2. The electric motor 18 can be controlled by means of the control unit 1 and serves for the selective driving of the compressor wheel 17. The compressor wheel 17 and the electric motor 18 are arranged coaxially on a common shaft 19, wherein the shaft 19 is formed along a central longitudinal axis 8 of the electric compressor 16. The compressor wheel 17 is arranged in a compressor wheel housing 20. The compressor wheel housing 20 is formed by the joining together of a first compressor wheel housing part 21 and a second compressor wheel housing part 22.

The electric motor 18 is designed as an internal-rotor electric motor and has a rotor 23 with permanent magnets 24 and a stator 25 with stator windings 26. The electric motor 18 serves to drive the compressor wheel 17. The rotor 23 of the electric motor 18 is formed integrally with the shaft 19. The compressor wheel 17 is arranged for conjoint rotation on the shaft 19. The rotational energy generated by the electric motor 18 is transferred to the compressor wheel 17 via the common shaft 19.

The control unit 1 is arranged coaxially with the electric motor 18 along the central longitudinal axis 8 of the electric compressor 16 and is connected electrically to the electric motor 18, more precisely to the stator windings 26 of the stator 25 of the electric motor 18, by at least one connecting element 27. The electric motor 18 is arranged in the housing 2. The housing 2 and the compressor wheel housing 20 thus form an overall compressor housing 28 (FIG. 2).

Figure 2:
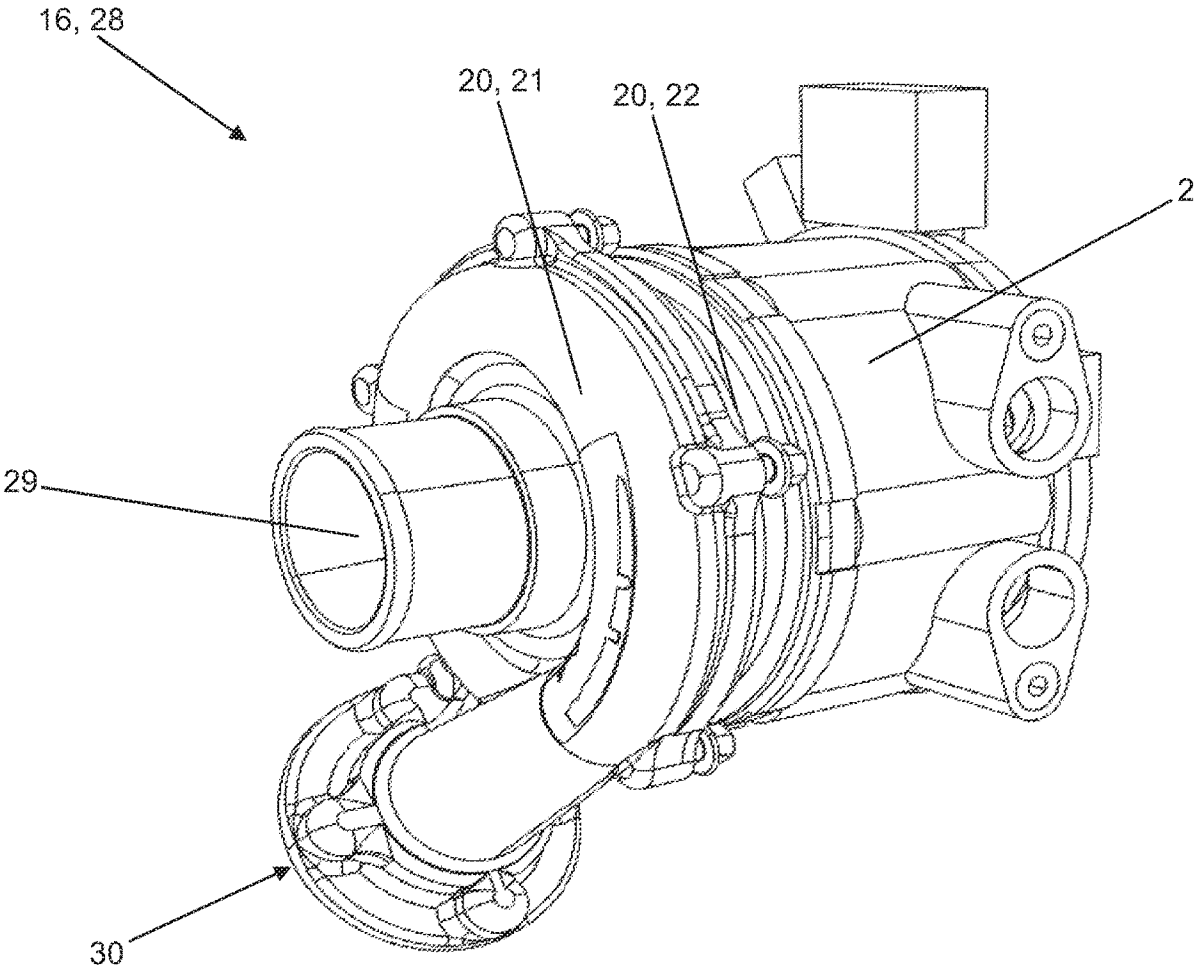
FIG. 2 shows a perspective view of an illustrative electric compressor according to the invention.

FIG. 2 shows, in a perspective view, the illustrative electric compressor 16 according to the invention shown in a longitudinal section in FIG. 1, wherein here a compressor gas inlet 29 and a compressor gas outlet 30 are formed on the first compressor wheel housing part 21 of the compressor wheel housing 20. Moreover, the assembly of the compressor wheel housing 20 and of the housing 2 to form the compressor housing 28 of the electric compressor 16 can be seen. The compressor wheel housing 20 can also be formed integrally with the housing 2 of the electric compressor 16.

Figure 3:
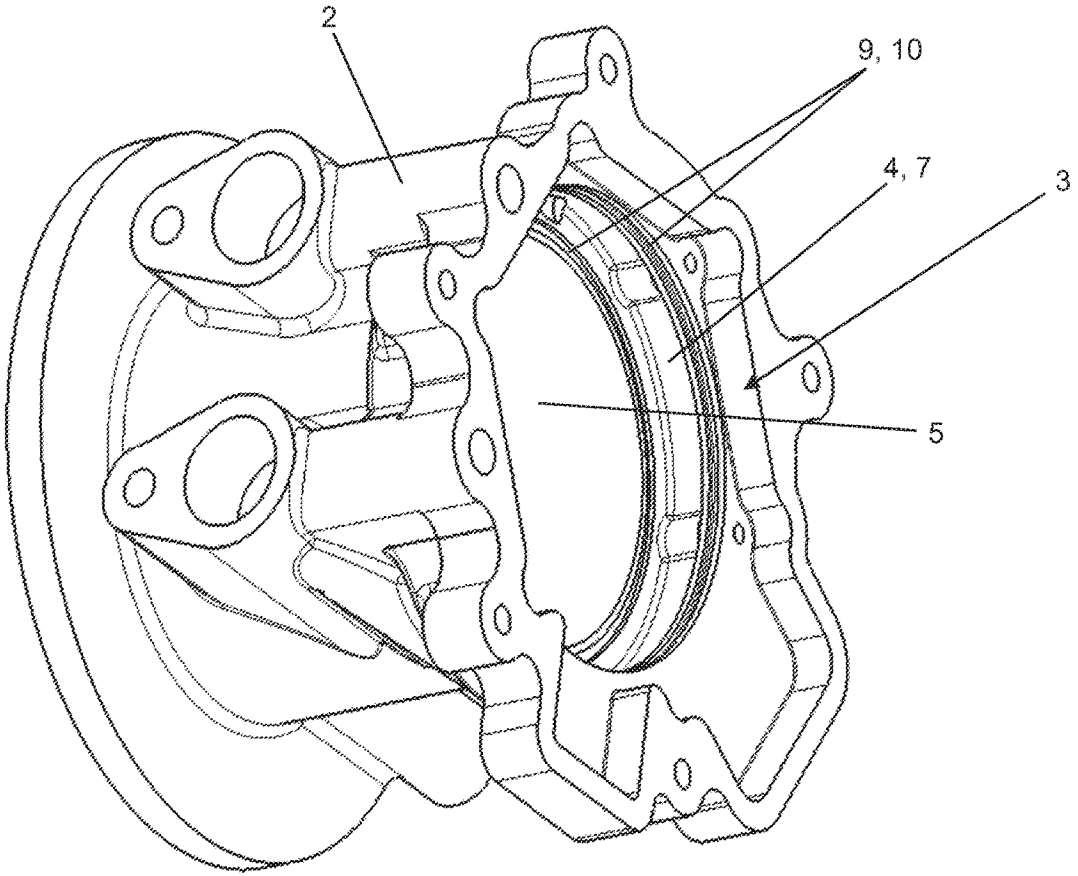
FIG. 3 shows a perspective view of a housing of an electric compressor.

FIG. 3 shows a perspective view of a housing 2 of the electric compressor 16. The housing 2 has at least one open end 3 to receive the control unit 1. In the region of the open end 3, the housing 2 is of substantially cylindrical design on its housing inner side 7. At the open end 3, the housing 2 has at least one recess 4 on the inner circumference, wherein the recess 4 is designed so as to be open in the direction of the housing interior 5 of the housing 2. The recess 4 is designed to be annular in shape along the housing inner side 7. In relation to a direction along a longitudinal axis 8 of the housing 2, the housing 2 has a respective annular groove 9 in front of and behind the recess 4. Annular, fully encircling seal elements 10 are placed in each of the annular grooves 9 (FIG. 4).

Figure 4:
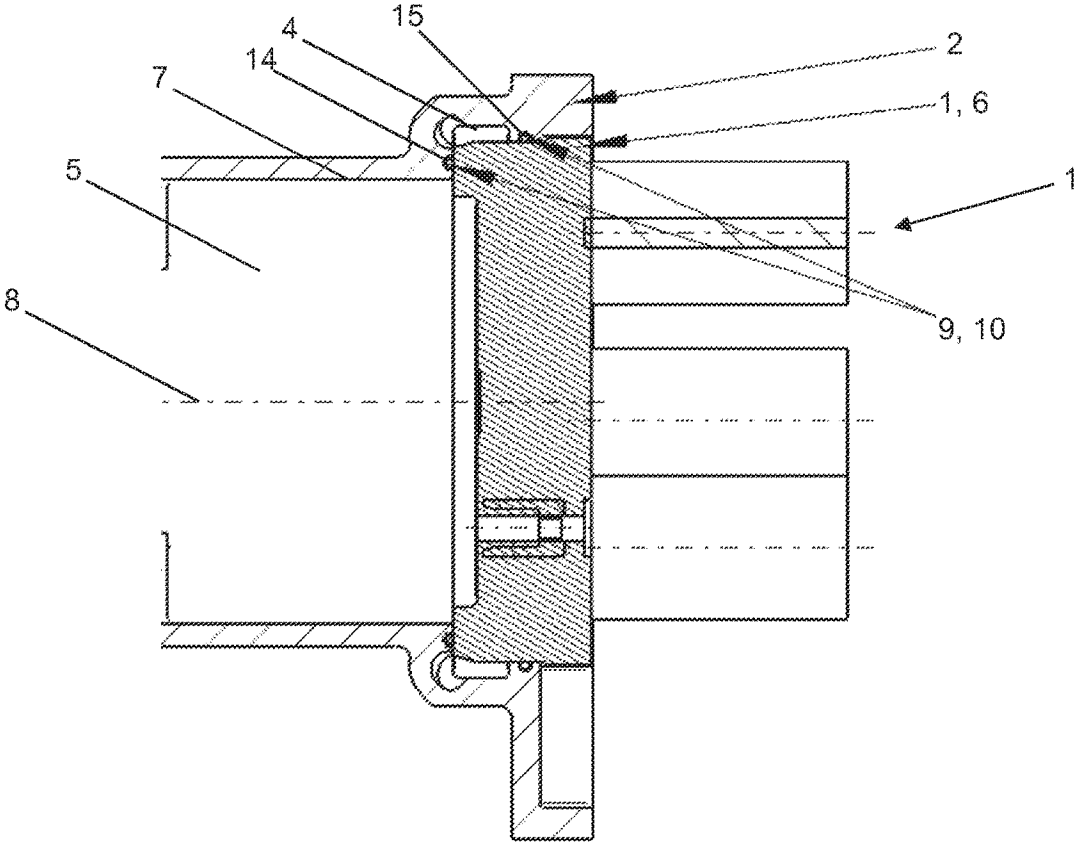
FIG. 4 shows a longitudinal section through a housing with an inserted control unit of an electric compressor.

FIG. 4 shows a longitudinal section of the housing 2 of the electric compressor 16 with the control unit 1 inserted. The control unit 1 is inserted into the housing 2 in such a way that, on the one hand, it closes the open end 3 of the housing 2 and, on the other hand, closes the recess 4 on the inner circumference. Sealing by means of the seal elements in the annular grooves 9 is effected through the interaction of the control unit 1 and the seal elements 10.

In FIG. 4, it can be seen that, by virtue of the formation of a respective groove 9 with in each case a seal element 10 arranged therein in front of and behind the recess 4 in relation to a direction along a longitudinal axis 8 of the housing 2, a first sealing region 14 in front of the recess 4 and a second sealing region 15 behind the recess 4 are formed by means of the inserted control unit 1. The recess 4 on the inner circumference of the housing 2 is designed to enable a cooling fluid to flow through. In this arrangement, the cooling fluid enters the recess 4 of the housing via a cooling fluid inlet 11 and leaves the recess 4 of the housing 2 again via a cooling fluid outlet 12 (FIG. 5).

Figure 5:
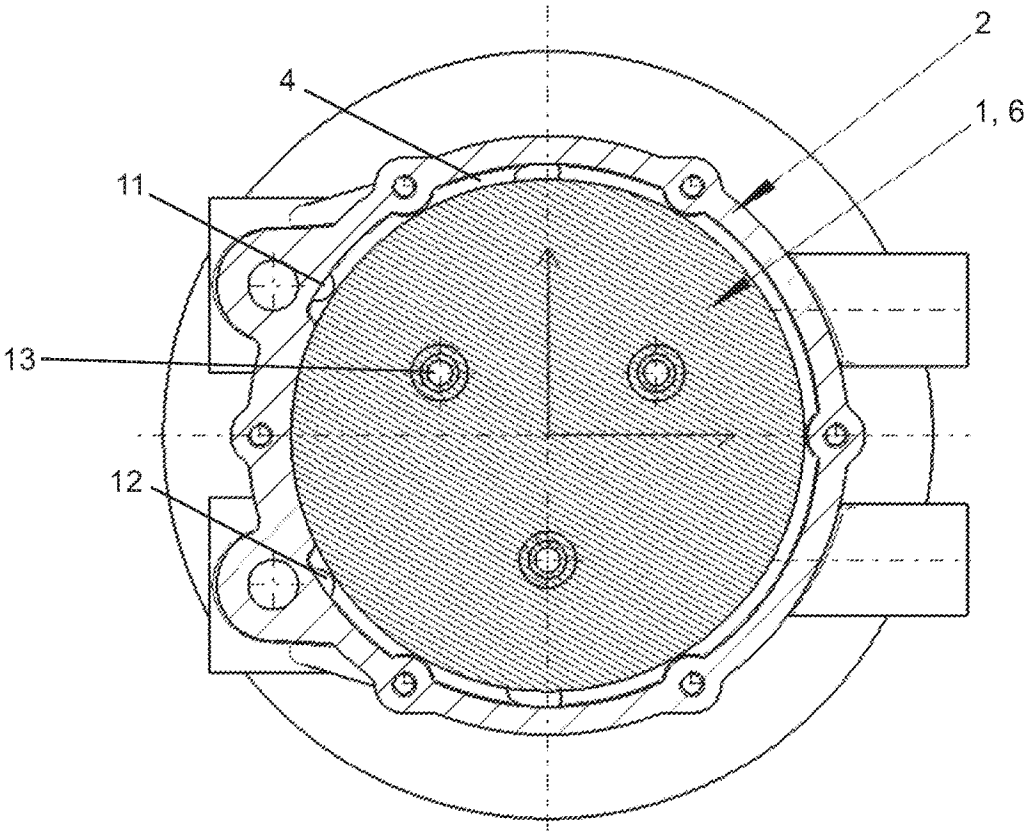
FIG. 5 shows a plan view of a housing with an inserted control unit of an electric compressor.

In the illustrative embodiment under consideration, the control unit 1 is almost completely surrounded, with the exception of contact points 13, by a jacket 6 (FIG. 4, FIG. 5). In particular, the control unit 1 is surrounded by the jacket 6 in the region in which the control unit 1 closes the recess 4.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SIGNS

1. control unit
2. housing
3. open end (of the housing)
4. recess
5. housing interior
6. jacket
7. housing inner side
8. longitudinal axis
9. groove
10. seal element
11. cooling fluid inlet
12. cooling fluid outlet
13. contact points
14. first sealing region
15. second sealing region
16. electric compressor
17. compressor wheel
18. electric motor
19. shaft
20. compressor wheel housing
21. first compressor wheel housing part
22. second compressor wheel housing part
23. rotor
24. permanent magnet
25. stator
26. stator winding
27. connecting element
28. compressor housing
29. compressor gas inlet
30. compressor gas outlet

What is claimed is:

1. An electric compressor for compressing a gas and configured for use in a motor vehicle, the electric compressor comprising:

a compressor wheel rotatable about an axis;

an electric motor configured to drive the compressor wheel;

a control unit configured to control the electric motor;

a housing including an interior terminating at an open end having an inner circumference and defining a recess extending radially into the inner circumference; and the control unit positioned in axial alignment with the recess and axially closing the open end and defining a continuous radial inner surface of a cooling duct formed by the recess radially between the control unit and the housing, wherein the cooling duct is sealed from the interior of the housing.

2. The electric compressor according to claim 1, wherein a cooling fluid flows through the recess on the inner circumference of the housing.

3. The electric compressor according to claim 1, wherein the control unit includes a jacket composed of a material of good thermal conductivity.

4. The electric compressor according to claim 1, wherein the housing is of substantially cylindrical design on the inner circumference at the open end, in the region of the open end.

5. The electric compressor according to claim 1, wherein the housing defines a first annular groove for receiving a seal element axially in front of the recess and wherein the housing defines a second annular groove for receiving a seal element axially behind the recess, and wherein at least one of the first and second grooves is defined along the inner circumference of the housing.

6. The electric compressor according to claim 1, wherein the housing is of single-part or multi-part construction.

7. The electric compressor according to Claire 1, wherein the electric motor of the electric compressor is arranged at least partially in the housing.

8. The electric compressor according to claim 2, wherein the cooling fluid cools the control unit.

9. The electric compressor according to claim 1 wherein at least one seal element is positioned radially between the control unit and the inner circumference of the housing axially outside of the recess.

10. The electric compressor according to claim 5 wherein a first seal is positioned in the first annular groove and wherein a second seal is positioned in the second annular groove.

11. The electric compressor according to claim 5 wherein the first and second annular grooves are defined between the housing and the control unit.

12. The electric compressor according to claim 1 wherein the housing defines a cooling flow inlet radially extending into the cooling duct and a cooling flow outlet radially extending from the cooling duct.

13. An electric compressor for compressing a gas and configured for use in a motor vehicle, the electric compressor comprising:

a housing extending about and along an axis and defining an interior compartment and terminating axially at an open end; the open end having an inner circumference defining a recess extending radially into the inner circumference and annularly along the inner circumference; a compressor wheel disposed in the interior compartment and rotatable about the axis; an electric motor disposed in the interior compartment and configured to drive the compressor wheel;

a control unit configured to control the electric motor and axially closing the open end of the housing and positioned axially over the recess and axially closing the open end and defining a continuous radial inner surface of a cooling duct formed by the recess radially between the control unit and the housing, wherein the cooling duct is sealed from the interior of the housing;

at least one seal element positioned radially between the control unit and the inner circumference of the housing axially outside of the recess.

14. The electric compressor according to claim 13 wherein the housing defines at least one annular groove receiving the at least one seal element.

15. The electric compressor according to claim 13 wherein the housing defines a cooling flow inlet radially extending into the cooling duct and a cooling flow outlet radially extending from the cooling duct.

16. The electric compressor according to claim 12 wherein the recess and the control unit each have a substantially circular shape.

* * * * *